US006612652B1

(12) United States Patent
Tenenboym et al.

(10) Patent No.: US 6,612,652 B1
(45) Date of Patent: Sep. 2, 2003

(54) THEATER SEAT ASSEMBLY

(75) Inventors: Alex Tenenboym, Farmington Hills, MI (US); Daniel M. Duhaime, Bloomfield Hills, MI (US); Mark Matthews, Casco, MI (US); Norman L. Freeman, Riverview, MI (US); Teh-Feng Fang, Farmington Hills, MI (US)

(73) Assignee: Greystone International, Inc., Byron Center, MI (US)

( * ) Notice: Subject to any disclaimer, the term of this patent is extended or adjusted under 35 U.S.C. 154(b) by 34 days.

(21) Appl. No.: 09/650,345

(22) Filed: Aug. 28, 2000

(51) Int. Cl.[7] ..... A47C 7/40

(52) U.S. Cl. ..... 297/354.1; 297/301.1; 297/301.3

(58) Field of Search ..... 297/354.1, 301.1, 297/301.3, 301.5, 354.11, 354.12

(56) References Cited

U.S. PATENT DOCUMENTS

| | | | | |
|---|---|---|---|---|
| 1,152,480 | A | | 9/1915 | Bouk |
| 1,213,920 | A | | 1/1917 | Symkowiak |
| 1,544,972 | A | | 7/1925 | Gebelein |
| 1,757,689 | A | | 5/1930 | Strickland |
| 1,987,346 | A | | 1/1935 | Mitchell |
| 2,000,916 | A | | 5/1935 | Bloom |
| 2,136,058 | A | | 11/1938 | Peppas |
| 2,164,116 | A | | 6/1939 | Lincoln |
| 2,272,505 | A | | 2/1942 | Biggs |
| 2,305,074 | A | | 12/1942 | Gedris |
| 2,312,638 | A | | 3/1943 | Gedris |
| 2,336,128 | A | | 12/1943 | Ronk |
| 2,347,931 | A | | 5/1944 | Bromagem |
| 2,419,412 | A | | 4/1947 | McArthur |
| 2,430,356 | A | | 11/1947 | McDonald |
| 2,439,370 | A | | 4/1948 | Orton |
| 2,451,923 | A | | 10/1948 | Cox et al. |
| 2,488,326 | A | | 11/1949 | Pratt |
| 2,492,103 | A | | 12/1949 | Merrill |
| 2,500,124 | A | | 3/1950 | Hoven |
| 2,523,960 | A | | 9/1950 | Liljengren et al. |
| 2,526,793 | A | | 10/1950 | Alfred |
| 2,595,582 | A | * | 5/1952 | Hoven et al. ..... 297/302.4 |
| 2,620,858 | A | | 12/1952 | Hoven et al. |
| 2,708,062 | A | | 5/1955 | Poyer |
| 2,842,187 | A | * | 7/1958 | Hendrickson ..... 297/335 |
| 2,963,256 | A | | 12/1960 | Borah |
| 3,039,616 | A | | 6/1962 | Proffit |
| 3,045,962 | A | | 7/1962 | Paulus |
| 3,077,364 | A | | 2/1963 | Eppink |
| 3,136,578 | A | | 6/1964 | Tihovici |
| 3,137,527 | A | | 6/1964 | Hoven et al. |
| 3,162,344 | A | | 12/1964 | Sabol |
| 3,182,377 | A | | 5/1965 | Hoven et al. |
| 3,186,673 | A | | 6/1965 | Olson |

(List continued on next page.)

FOREIGN PATENT DOCUMENTS

| | | |
|---|---|---|
| FR | 2233798 | 2/1975 |
| GB | 550212 | 12/1942 |

*Primary Examiner*—Anthony D. Barfield
(74) *Attorney, Agent, or Firm*—Bliss McGlynn, P.C.

(57) ABSTRACT

A theater seat assembly includes a pair of opposed stanchions for attachment to a support surface, a generally horizontal seat portion disposed between and operatively connected to the stanchions, and a generally upright back portion disposed between and operatively connected to the stanchions. The theater seat assembly may include a lounge mechanism operatively connected to the back portion and the stanchions to allow the back portion to lounge rearward relative to the stanchion. The theater seat assembly may also include a cushion suspension system operatively connected to the seat portion and the stanchions to allow the seat portion to deflect downwardly relative to the stanchions. The theater seat assembly may further include each one of the seat portion and the back portion having a frame, a cushion disposed adjacent the frame and a trim cover covering the cushion and attached to the frame.

7 Claims, 7 Drawing Sheets

U.S. PATENT DOCUMENTS

| | | | | |
|---|---|---|---|---|
| 3,215,467 | A | | 11/1965 | McFarland et al. |
| 3,233,940 | A | | 2/1966 | Tooley, Jr. |
| 3,338,629 | A | | 8/1967 | Drees |
| D214,934 | S | | 8/1969 | Pitts |
| 3,468,582 | A | | 9/1969 | Judd |
| 3,497,076 | A | | 2/1970 | O'Brien |
| 3,498,470 | A | | 3/1970 | Thomas |
| 3,563,604 | A | | 2/1971 | Barecki |
| 3,606,112 | A | | 9/1971 | Cheshier |
| 3,638,998 | A | | 2/1972 | Anderson |
| 3,675,969 | A | | 7/1972 | Gage |
| 3,690,724 | A | | 9/1972 | Douglas et al. |
| 3,768,710 | A | | 10/1973 | Eggers |
| 3,840,239 | A | | 10/1974 | Fazekas et al. |
| 3,850,476 | A | | 11/1974 | Day |
| 3,955,672 | A | | 5/1976 | Brundage |
| 4,099,780 | A | | 7/1978 | Schmidhuber |
| 4,133,579 | A | | 1/1979 | Springfield |
| 4,174,866 | A | | 11/1979 | Rhyan |
| 4,262,962 | A | | 4/1981 | Yust |
| 4,458,943 | A | | 7/1984 | Krakauer |
| 4,548,326 | A | | 10/1985 | Danna et al. |
| 4,721,216 | A | | 1/1988 | Kinder |
| 4,795,211 | A | | 1/1989 | Stern et al. |
| 4,861,108 | A | | 8/1989 | Acton et al. |
| 4,863,134 | A | | 9/1989 | Young et al. |
| D311,105 | S | | 10/1990 | Stern et al. |
| 5,040,846 | A | | 8/1991 | Finney et al. |
| 5,052,649 | A | | 10/1991 | Hunnicutt |
| 5,288,128 | A | | 2/1994 | Smith et al. |
| 5,302,000 | A | | 4/1994 | Ayotte |
| 5,320,411 | A | | 6/1994 | Sera |
| 5,375,914 | A | | 12/1994 | Donnelly |
| 5,393,120 | A | * | 2/1995 | Woods et al. ..... 297/301.3 |
| 5,424,017 | A | | 6/1995 | Hinduja et al. |
| 5,465,891 | A | | 11/1995 | Bridges |
| 5,522,182 | A | | 6/1996 | Rogers |
| 5,567,016 | A | | 10/1996 | Koprowski |
| 5,601,335 | A | | 2/1997 | Woods et al. |
| 5,681,085 | A | * | 10/1997 | Nahoul ..... 297/302.1 X |
| 5,899,531 | A | | 5/1999 | Koehler |

* cited by examiner 10
12
16
18
20
20a
21
21a
22
24
26
27
28
30
32
34
38
40
54
56
58
60
61
63
75
78
79a
79b
80
81
82
84
85
86
88
89
90
92
94
96
98
128
130
132
134
136
138
140
142
144
146
148
150
152
156
157
158
160

THEATER SEAT ASSEMBLY

BACKGROUND OF THE INVENTION

1. Field of the Invention

The present invention relates generally to seats and, more specifically, to a theater seat assembly.

2. Description of the Related Art

It is known to provide theater seats for a theater such as a movie theater. Typically, the theater seat includes a generally horizontal seat portion and a generally vertical back portion operatively connected to the seat portion. The seat portion includes a seat frame and a cushion attached to the seat frame. The back portion is fixed relative to the seat portion by a stanchion secured to a floor of the theater. The seat portion pivots relative to the stanchion and back portion.

Although the above theater seats have worked, it is desirable to provide further cushioning of the seat portion. It is also desirable to provide a great deal of comfort and structural integrity to the seat portion. It is further desirable to provide the back portion with a lounge mechanism to allow the back portion to lounge and not leave a potential pinching hazard.

SUMMARY OF THE INVENTION

Accordingly, the present invention is a theater seat assembly including a pair of opposed stanchions for attachment to a support surface, a generally horizontal seat portion disposed between and operatively connected to the stanchion, and a generally upright back portion disposed between and operatively connected to the stanchions. The theater seat assembly may include a lounge mechanism operatively connected to the back portion and the stanchions to allow the back portion to lounge rearward relative to the stanchions. The theater seat assembly may also include a cushion suspension system operatively connected to the seat portion and the stanchions to allow the seat portion to deflect downwardly relative to the stanchions. The theater seat assembly may further include each one of the seat portion and the back portion having a frame, a cushion disposed adjacent the frame and a trim cover covering the cushion and attached to the frame.

One advantage of the present invention is that an improved theater seat assembly is provided. Another advantage of the present invention is that the theater seat assembly has a cushion suspension system to provide comfort and structural integrity to the seat portion. Yet another advantage of the present invention is that the cushion suspension system has an elastomer reinforced fabric as suspension. Still another advantage of the present invention is that the theater seat assembly has a lounge mechanism to allow the back portion to lounge relative to the seat portion and not leave a pinching hazard. A further advantage of the present invention is that the theater seat assembly has a combination of a pivot and torsion spring.

Other features and advantages of the present invention will be readily appreciated, as the same becomes better understood, after reading the subsequent description when taken in conjunction with the accompanying drawings.

DESCRIPTION OF THE PREFERRED EMBODIMENT(S)

Figure 2:
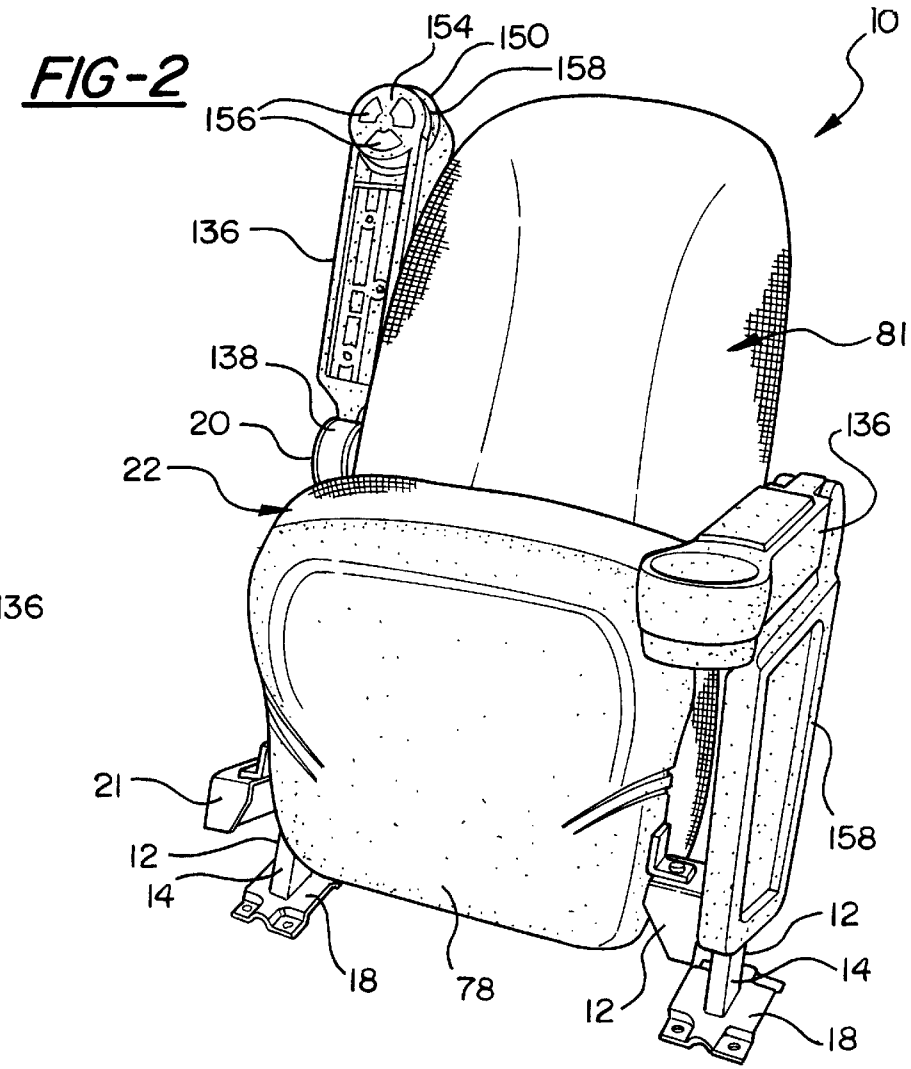
FIG. 2 is a front perspective view of the theater seat assembly of FIG. 1.
Figure 1:
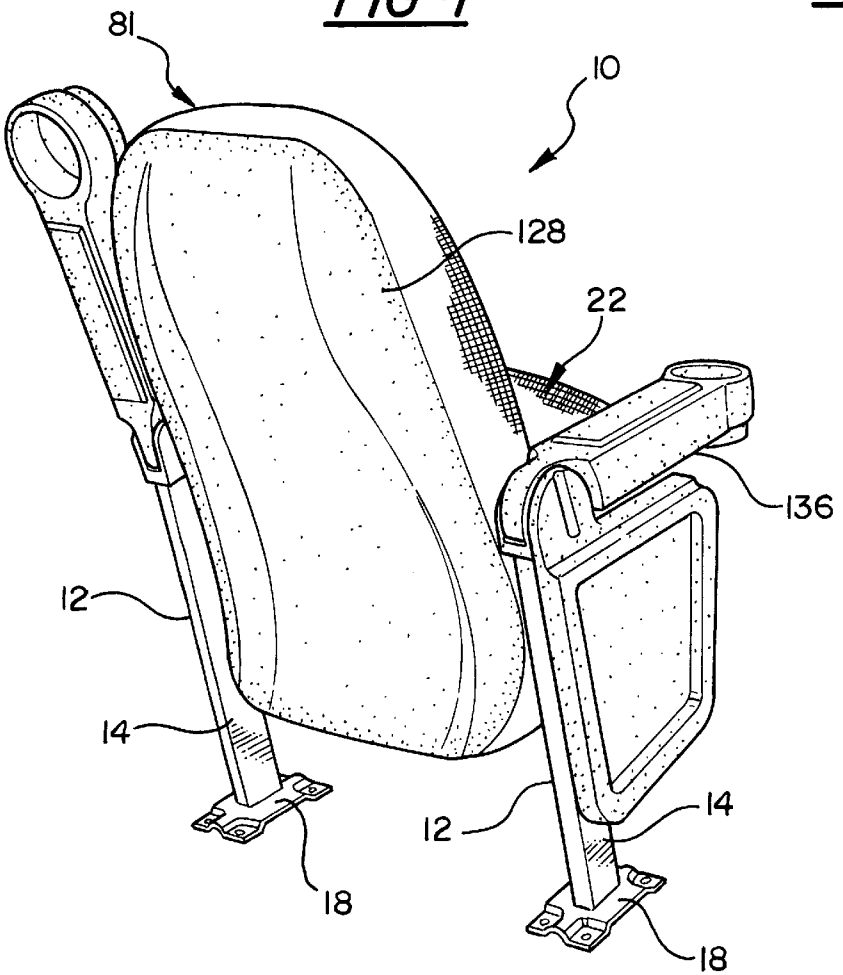
FIG. 1 is a rear perspective view of a theater seat assembly, according to the present invention.

Referring now to the drawings and in particular FIGS. 1 through 4, one embodiment of a theater seat assembly 10, according to the present invention, is shown for a theater such as a movie theater (not shown). The theater seat assembly 10 includes a stanchion 12 for supporting and securing the theater seat assembly 10 to a support surface (not shown) such as a floor of the movie theater. The stanchion 12 includes a leg portion 14 extending generally vertically at a predetermined angle and an arm portion 16 extending generally perpendicular to the leg portion 14. The leg portion 14 and arm portion 16 are generally tubular members having a generally rectangular cross-sectional shape. The stanchion 12 includes a foot portion 18 at a lower end of the leg portion 14 for attachment by suitable means such as fasteners (not shown) to the support surface. The foot portion 18 is generally rectangular in shape. The stanchion 12 also includes a bracket portion 20 at an upper end of the leg portion 14 for a function to be described. The bracket portion 20 is generally U-shaped. The bracket portion 20 has a plurality of apertures 20*a* extending therethrough for a function to be described. The stanchion 12 includes a support bracket 21 at one end of the arm portion 16. The support bracket 21 has an aperture 21*a* extending therethrough for a function to be described. The stanchion 12 is made of a metal material such as steel. It should be appreciated that the stanchion 12 is integral and connected together by suitable means such as welding.

The theater seat assembly 10 also includes a seat portion, generally indicated at 22, operatively connected to the stanchion 12. The seat portion 22 includes a seat cushion 24 and a seat trim cover 26 covering the seat cushion 24. The seat cushion 24 is generally rectangular in shape, but may have any suitable shape. The seat cushion 24 is made of a foam material such as urethane foam. The seat trim cover 26 is made of a flexible material such as cloth, vinyl, leather or a combination thereof. The seat trim cover 26 has at least one, preferably a plurality of J-shaped retainers 27 (FIG. 5) attached to a periphery thereof by suitable means such as by stitching or sewing. The retainers 27 are made of a suitable plastic material. The retainers 27 are attached to a plurality of interior flanges 42 of a seat frame 30 to be described. It should be appreciated that the seat cushion 24 will be enclosed by the seat trim cover 26 and the retainers 27 will keep the seat cushion 24 and seat trim cover 26 in place when the retainers 27 are disposed over the interior flanges 42 of the seat frame 30 to be described.

Figure 3:
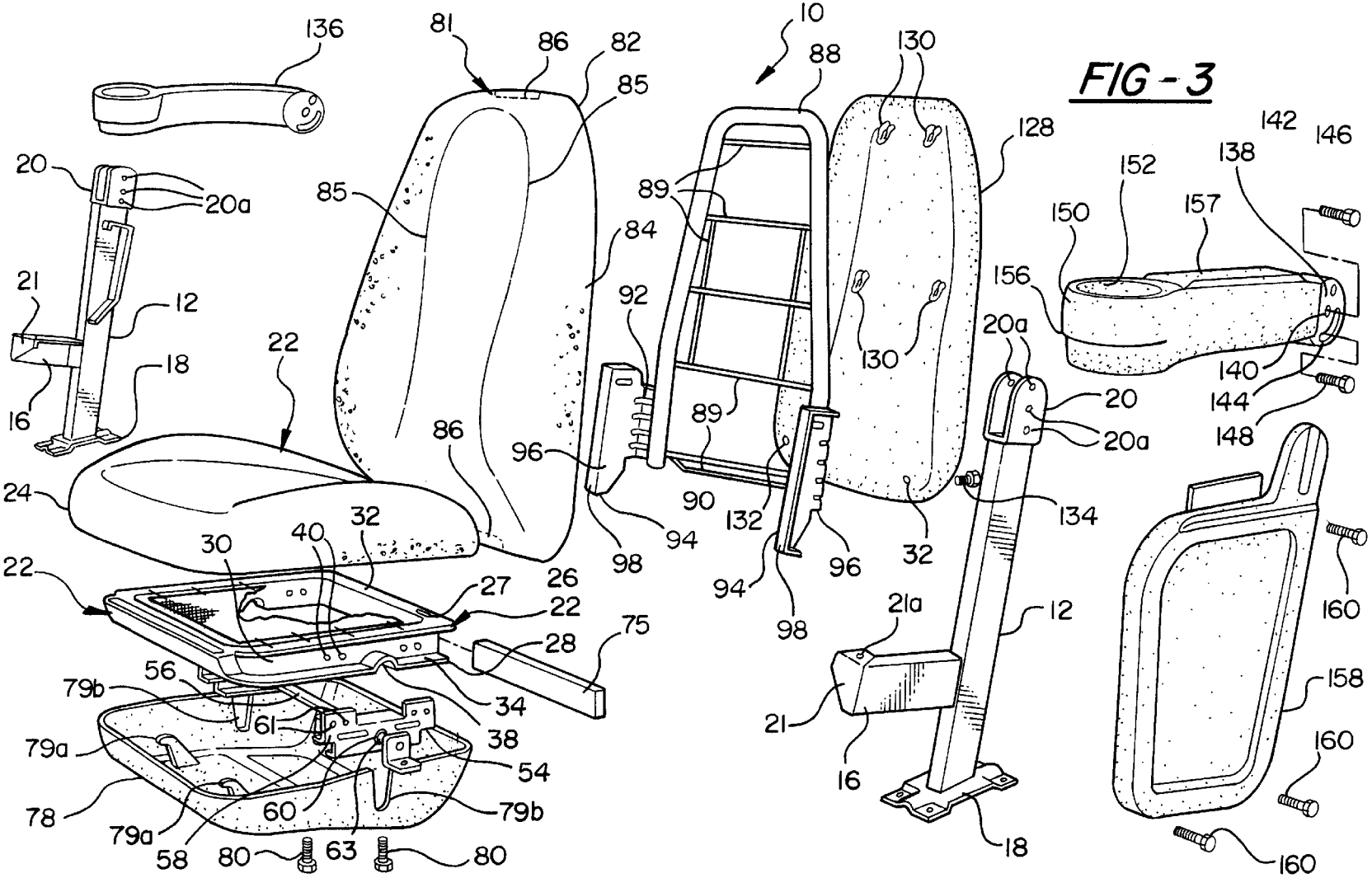
FIG. 3 is an exploded perspective view of the theater seat assembly of FIGS. 1 and 2.
Figure 4:
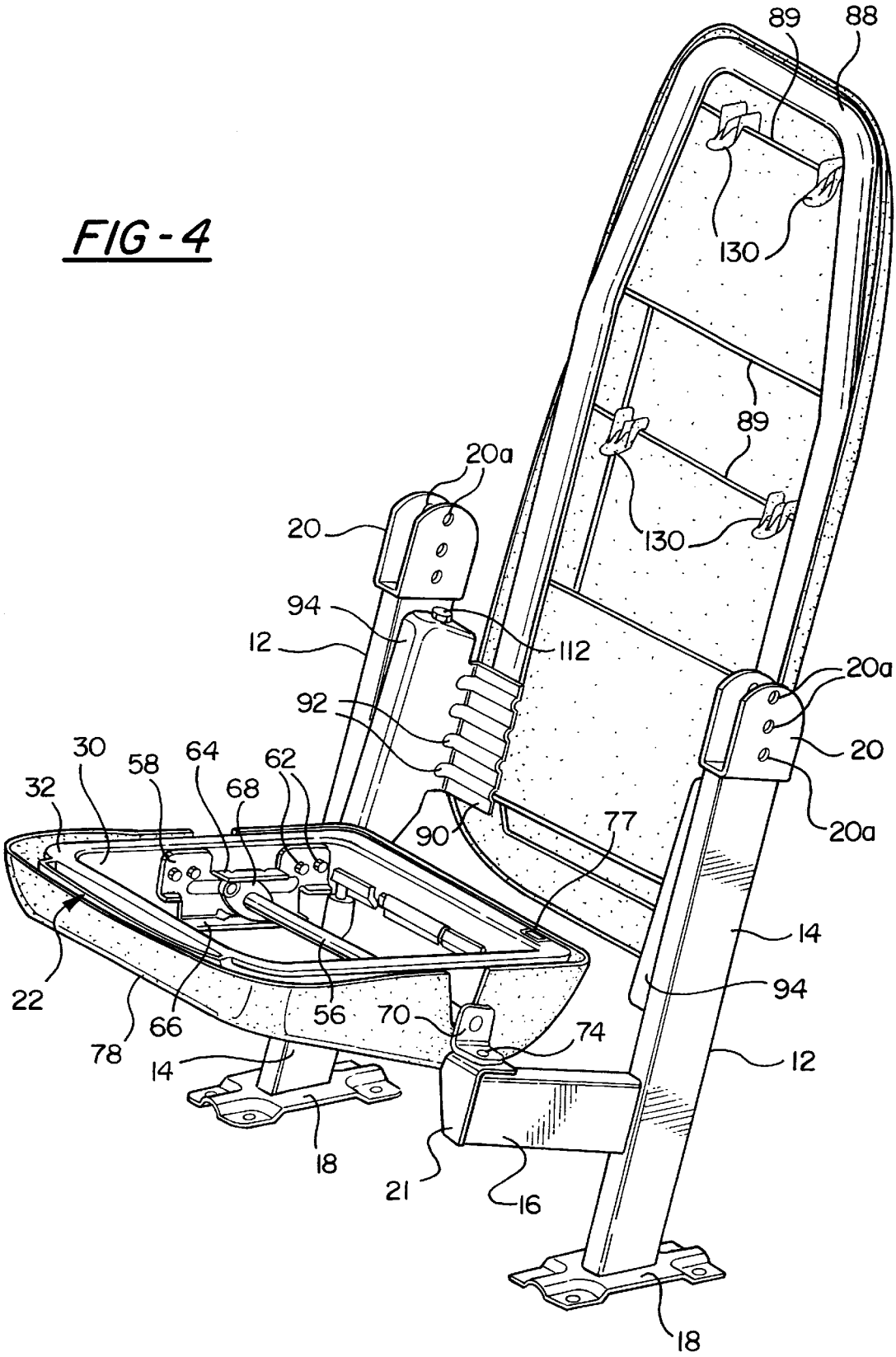
FIG. 4 is a perspective view of the theater seat assembly of FIGS. 1 and 2 illustrating cushions removed.
Figure 5:
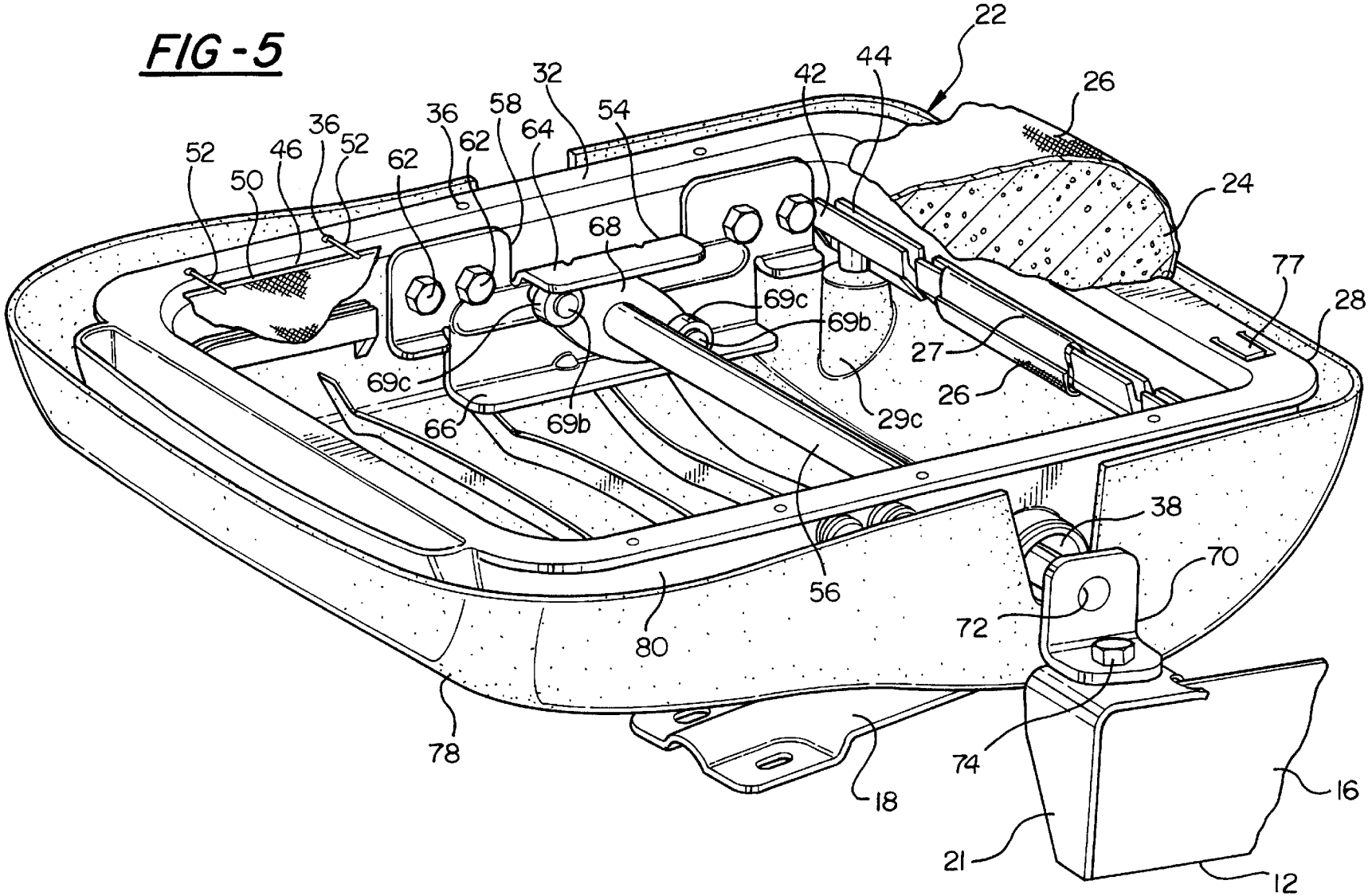
FIG. 5 is an enlarged perspective view of a seat portion of the theater seat assembly of FIGS. 1 and 2 with the cushion removed.

Referring to FIGS. 3 through 5, the seat portion 22 includes a seat cushion suspension system 28 operatively connected to the seat cushion 24 and the stanchion 12 to allow the seat portion 22 to deflect downwardly relative to the stanchion 12. The seat cushion suspension system 28 includes a seat frame 30 to support the seat cushion 24. The seat frame 30 is generally rectangular in shape, but may have any suitable shape. The seat frame 30 includes an upper flange 32 extending outwardly generally perpendicular thereto and a lower flange 34 spaced vertically from the upper flange 32 and extending outwardly generally perpendicular thereto. The upper flange 32 may include a plurality of apertures 36 extending therethrough and spaced therealong for a function to be described. The lower flange 34 has a recess 38 with a generally curved or arcuate shape for a function to be described. The seat frame 30 also has a plurality of apertures 40 extending therethrough for a function to be described. The seat frame 30 further includes at least one, preferably a plurality of interior flanges 42 extending therealong and having a channel 44 therein to receive one end of the retainers 27. The seat frame 30 is made of a rigid material such as plastic. It should be appreciated that the seat frame 30 is integral, unitary and formed as one-piece by conventional injection molding.

Figure 7:
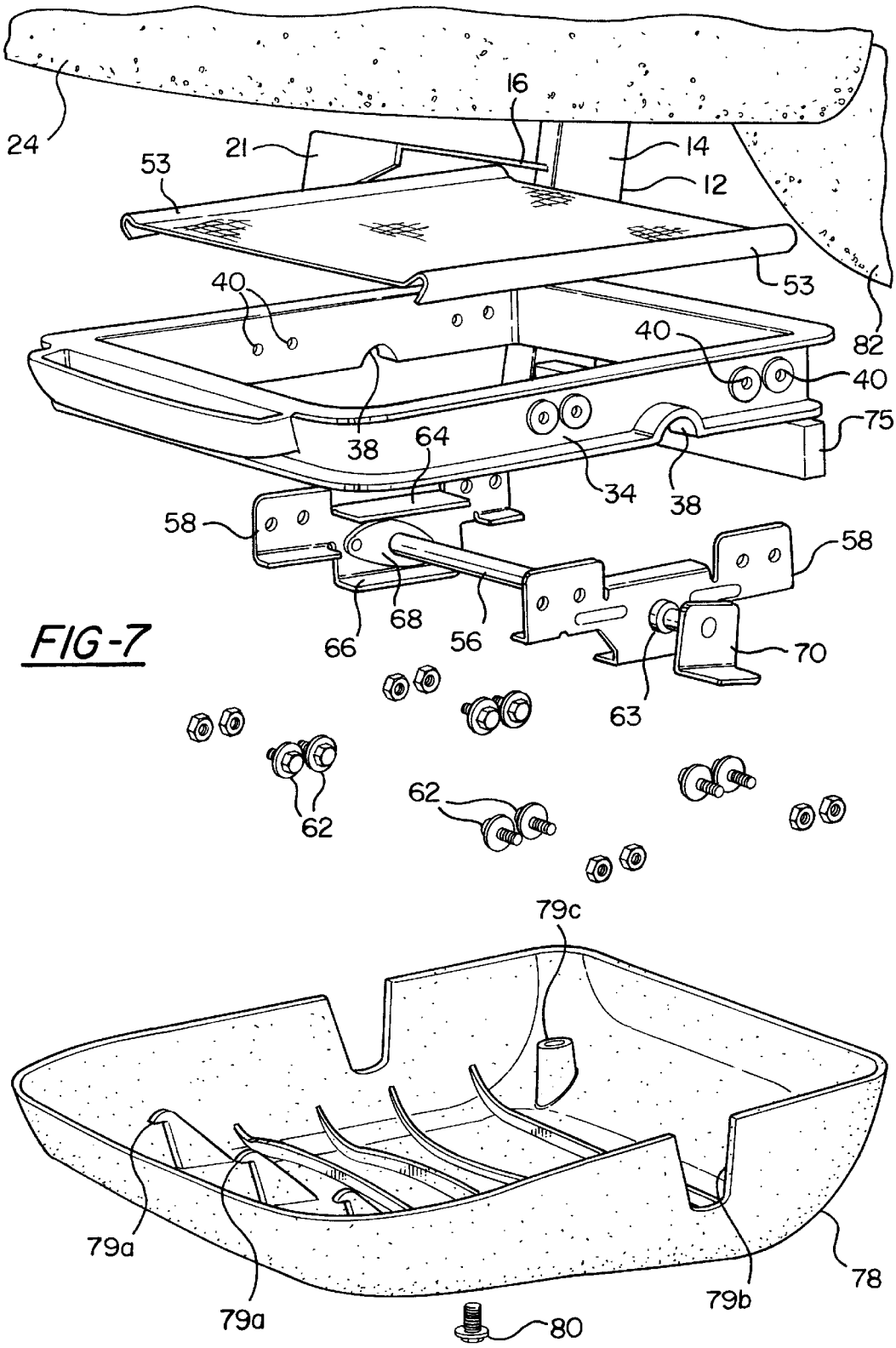
FIG. 7 is a partial exploded perspective view of another embodiment, according to the present invention, of the theater seat assembly of FIG. 1 and 2.

The seat cushion suspension system 28 includes a seat suspension 46 connected to the seat frame 30. The seat suspension 46 has a suspension member 48 made from a one-piece elastomer reinforced fabric known as Dymetrol. The suspension member 48 is generally rectangular in shape. The seat suspension 46 may include a pair of opposed support wires 50 extending longitudinally along the sides of the suspension member 48. The support wires 50 are linear or straight and made of a metal material such as steel. The support wires 50. are cut-to-length to the same length as the sides of the suspension member 48. The support wires 50 are disposed along the sides of the suspension member 48 by wrapping a portion of the sides of the suspension member 48 over the support members and stitching the suspension member 48 to itself to form a channel for the support wires 50. The seat suspension 46 may include a plurality of seat hooks 52 extending outwardly from the support wires 50. Preferably, there are four seat hooks 52 spaced longitudinally along each side of the suspension member 48 for a total of eight seat hooks 52. The seat hooks 52 have a general "C" shape with one end extending through the suspension member 48 and disposed about one of the support wires 50 and the other end disposed through one of the apertures 36 in the upper flange 32 of the seat frame 30. The seat hooks 52 are made of a metal material such as steel. In another embodiment illustrated in FIG. 7, the seat suspension 46 includes at least one, preferably a plurality of J-shaped retainers 53 similar to the retainers 27 are attached to the longitudinal sides of the suspension member 48 by suitable means such as by stitching or sewing. The retainers 53 are made of a suitable plastic material and attached to the upper flange 32 of the seat frame 30. It should be appreciated that the retainers 53 will keep the suspension member 48 in place when the retainers 53 are disposed over the upper flange 32 of the seat frame 30. It should also be appreciated that the seat suspension 46 is pre-assembled and then attached to the seat frame 30 with the seat hooks 52 to keep the suspension member 48 in place.

The seat portion 26 includes a counter-balanced pivot mechanism 54 connected to the seat cushion suspension 28 and the stanchion 12. The counter-balanced pivot mechanism 54 includes a center member 56. The center member 56 is a cylindrical rod extending laterally and having a generally circular cross-sectional shape. The center member 56 is made of a metal material such as steel.

The counter-balanced pivot mechanism 54 also includes a pair of pivot center brackets 58 with one near each end of the center member 56. The pivot center brackets 58 are generally planar and extend longitudinally and vertically. Each of the pivot center brackets 58 has a first aperture 60 extending therethrough to receive the center member 56 and at least one, preferably a plurality of second apertures 61 extending therethrough to receive a fasteners 62 to connect the pivot center bracket 58 to the seat frame 30. The pivot center bracket 58 has a bushing 63 disposed in the aperture 60 and about the pivot center member 56. The bushing 63 is made of a metal material such as bronze or steel. The pivot center bracket 58 also has an upper flange 64 extending longitudinally and inwardly generally perpendicular thereto. The pivot center bracket 58 also has a lower flange 66 spaced vertically from the upper flange 64 and extending longitudinally and inwardly generally perpendicular thereto. The pivot center bracket 58 is made of a metal material such as steel. It should be appreciated that the pivot center brackets 58 rotate or pivot relative to the center member 56 via the bushings 63, in turn, rotating or pivoting the seat frame 30.

The counter-balanced pivot mechanism 54 further includes a stop member 68 disposed about and fixed to the center member 56 near each end thereof between the upper and lower flanges 64 and 66 of the pivot center bracket 58. The stop member 68 is generally oval in shape and made of a metal material such as steel. The stop member 68 includes an upper pin portion 69*a* and a lower pin portion 69*b* extending inwardly and a bumper 69*c* disposed about the pin portion 69*a* and 69*b*. The bumper 69*c* is made of an elastomeric material such as rubber and contacts the upper and lower flanges 64 and 66 when the pivot center brackets 58 and seat frame 30 are pivoted relative to the center member 56.

The counter-balanced pivot mechanism 54 includes an attachment bracket 70 at each end of the center member 56. The attachment bracket 70 is generally L shaped and made of a metal material such as steel. The attachment bracket 70 has a second aperture 72 extending through a first portion thereof to receive the center member 56 and has a second aperture (not shown) extending through a second portion thereof to receive a fastener 74 to attach the attachment bracket 70 to the support bracket 21 on the arm portion 16 of the stanchion 12. It should be appreciated that the pivot center brackets 58 rotate relative to the center member 56. It should also be appreciated that the center member 56 is located rearward from a center of the seat frame 30 to counter-balance a weight of the seat portion 26.

Figure 8:
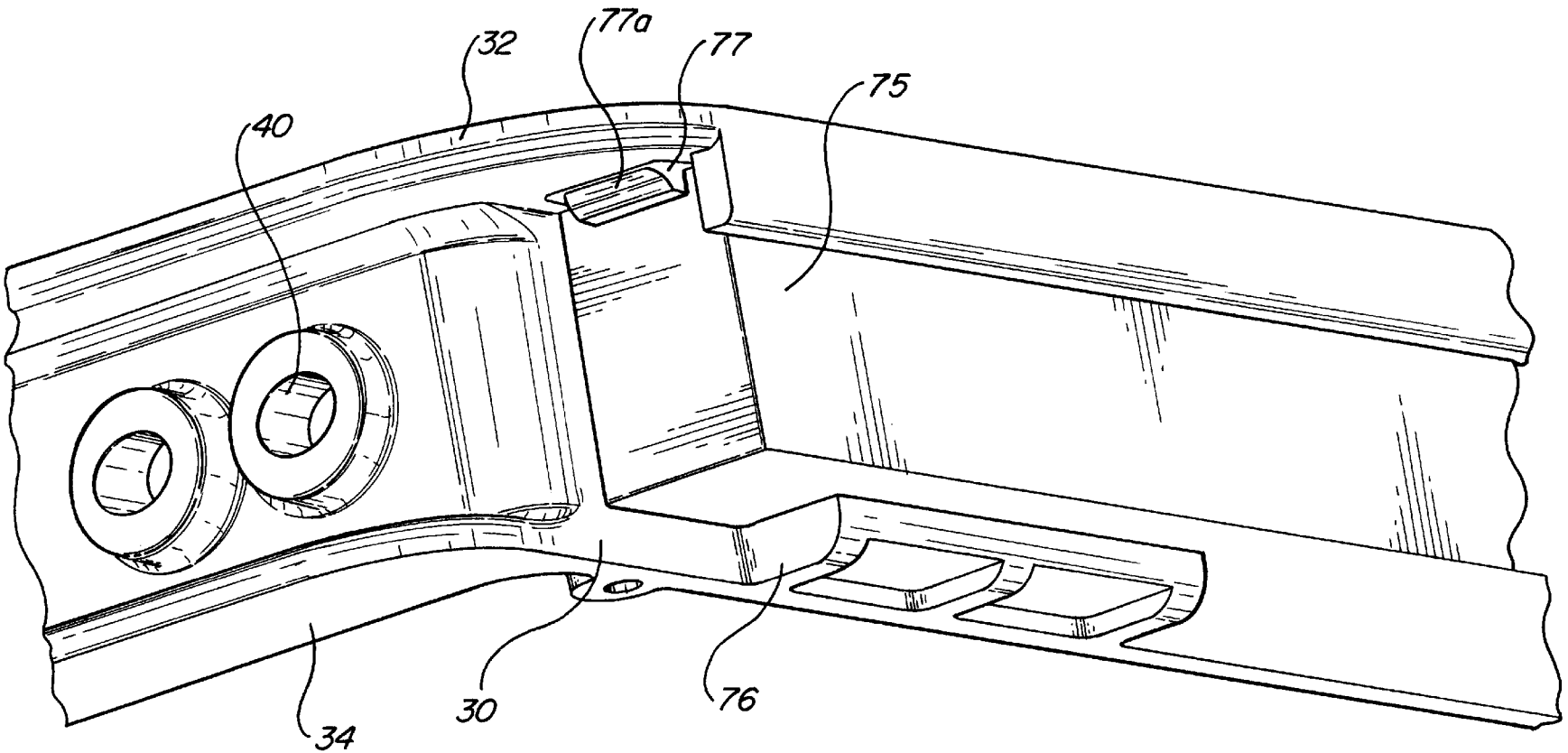
FIG. 8 is a partial rear perspective view of a portion of the theater seat assembly of FIGS. 1 and 2.

As illustrated in FIG. 8, the counter-balanced pivot mechanism 54 also includes a counter-weight 75 removably secured to the seat frame 30. The counter-weight 75 is generally rectangular in shape and made of metal material such as lead. The counter-weight 75 is disposed on a rear side of the seat frame 30 and supported by at least one, preferably a pair of lower ledges 76 between the upper flange 32 and the lower ledges 76. The upper flange 32 has a deflectable finger 77 having a projection 77*a* and is deflectable to allow the counter-weight 75 to be slid and disposed between the lower ledges 76 and the upper flange 32. The projection 77*a* and a stop (not shown) on one of the lower ledges 76 prevent the counter-weight 75 from exiting the seat frame 30. It should be appreciated that the counter-weight 75 may be deflected upwardly to allow the counter-weight 75 to be slid past the projection 77*a* to remove the counter-weight 75 from the seat frame 30. It should also be appreciated that the counterweight 75 is of a sufficient mass to allow a front of the seat frame 30 to rotate upwardly when the seat portion 22 is unoccupied.

The seat portion 22 includes a seat cover 78 to cover the bottom of thereof. The seat cover 78 has a generally rectangular shape, but may have any suitable shape. The seat cover 78 is made of fiberglass reinforced co-polymer plastic material and formed by conventional injection molding processes. The seat cover 78 has a pair of forward hooks 79*a*, a pair of side recess 79*b* and a pair of rear bosses 79*c* that allow the seat cover 78 to be attached to the seat frame 30. The seat cover 78 is disposed over the bottom of the seat frame 30 and the hooks 79*a* are disposed over a forward interior flange 42 and the recesses 79*b* receive the center member 56. The seat cover 78 is secured to the seat frame 30 by suitable means such as fasteners 80 extending through the bosses 79*c* and engaging the lower flange 34 of the seat frame 30. It should be appreciated that fiberglass strengthens the seat cover 78.

The theater seat assembly 10 also includes a back portion, generally indicated at 81, operatively connected to the stanchion 12. The back portion 81 includes a back cushion 82 and a back trim cover 84 covering the back cushion 82. The back cushion 82 is generally rectangular in shape, but may have any suitable shape. The back cushion 82 is made of a foam material such as urethane foam. The back trim cover 84 is a flexible material such as cloth, vinyl, leather or a combination thereof. The back trim cover 84 has at least one, preferably a plurality of J-shaped retainers 86 attached to a periphery thereof by suitable means such as by stitching or sewing. The retainers 86 at a top and bottom of the back trim cover 84 are attached to bars 89 of a back frame 88 to be described. The retainers 86 on the sides are attached to each other similar to a bra. Additionally, the back trim cover 84 may include extensions (not shown) forming creases 85 extending through the back cushion 82 and attached to the bars 89 of the back frame 88. It should be appreciated that the back cushion 82 will be enclosed by the back trim cover 84 and the retainers 86 will keep the back cushion 82 and back trim cover 84 in place when the retainers 86 are disposed over a back frame 88 to be described.

Figure 6:
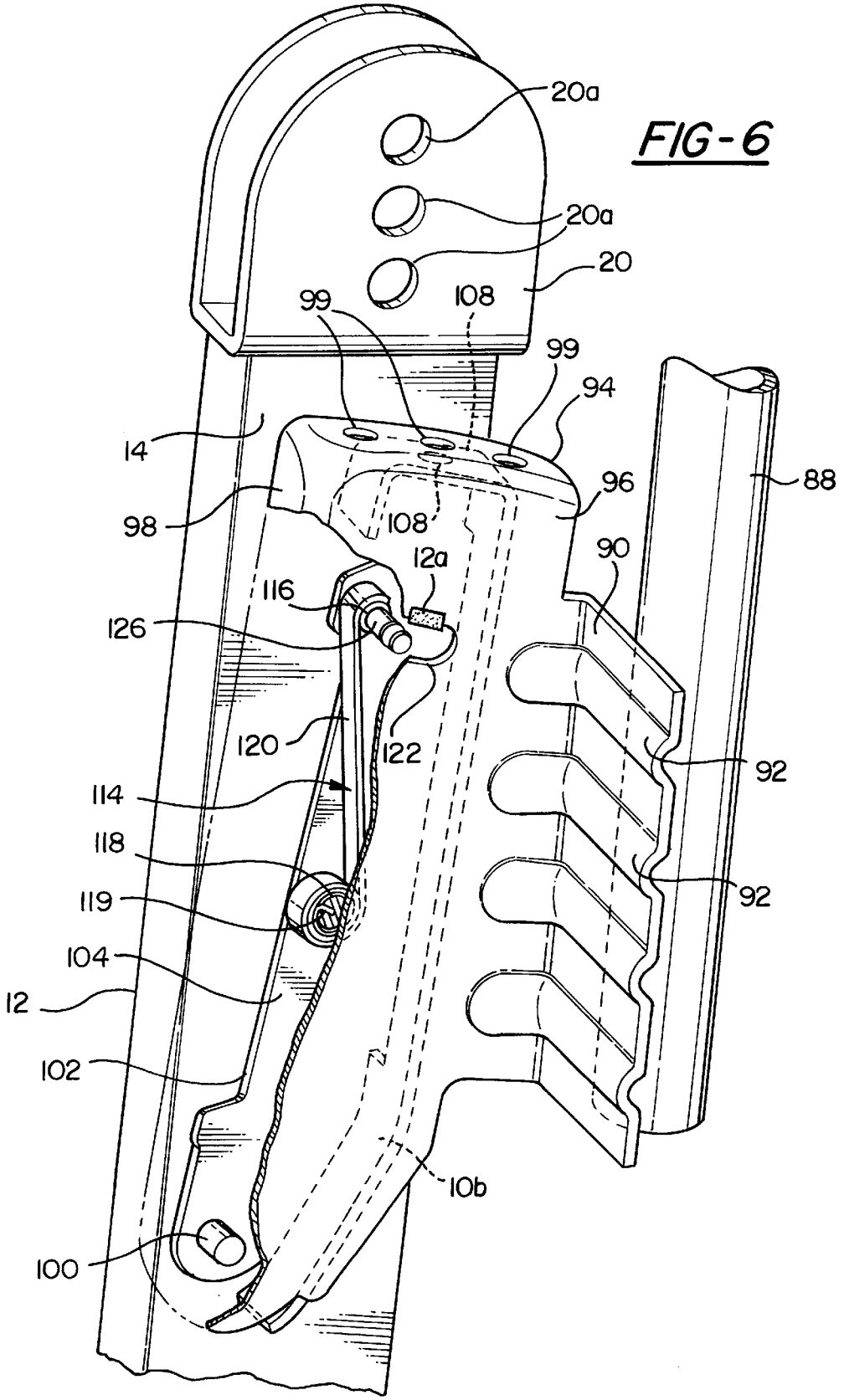
FIG. 6 is an enlarged perspective view of a portion of the theater seat assembly of FIGS. 1 and 2 with the cushion removed.

Referring to FIGS. 3, 4 and 6, the back portion 81 includes a back frame 88 operatively connected to the back cushion 82 and the stanchion 12. The back frame 88 is generally an inverted U shape, but may have any suitable shape to support the back cushion 82. The back frame 88 includes at least one, preferably a plurality of bars 89 extending therebetween to support the back cushion 82. The back frame 88 also includes a lower flange 90 extending outwardly laterally at lower end thereof. The lower flange 90 is generally rectangular in shape and may have one or more ribs 92 therein. The back frame 88 also includes a side housing 94 extending forwardly from the lower flange 90 and generally perpendicular thereto. The side housing 94 has a base wall 96 and a side wall 98 extending outwardly generally perpendicular thereto along a top, bottom and forward edge thereof. The top of the sidewall 98 may include at least one, preferably a plurality of apertures 99 for a function to be described. The side housing 94 has a recess (not shown), which is disposed over a pin member 100 extending inwardly from the leg portion 14 of the stanchion 12. The back frame 88 is made of a metal material such as steel. It should be appreciated that the lower flange 90 and side housing 94 are integral and formed as one-piece from a metal material such as steel and connected to the back frame 88 by suitable means such as welding. It should also be appreciated that the back frame 88 is integral and connected together by suitable means such as welding.

The back portion 81 includes an attachment bracket 102 attached to the leg portion 14 of the stanchion 12. The attachment bracket 102 has a base wall 104 that is generally planar and secured to the leg portion 14 by suitable means such as welding. The pin member 100 is secured to a lower end of the base wall 104 by suitable means such as welding. The attachment bracket 102 also includes a sidewall 106 extending generally perpendicular to the base wall 104 along a rear edge thereof. The sidewall 106 has a generally inverted "L" shape. In one embodiment, the sidewall 106 has an upper portion 108 with an aperture 110 extending therethrough. The aperture 110 is preferably threaded to receive a fastener 112 that extends through one of the apertures 99 in the side housing 94 to fix the position of the back portion 81 relative to the stanchion 12. It should be appreciated that the apertures 99 allow various positions of the back portion 81 relative to the stanchion 12 for different positions of the seat 10 within the theater. It should also be appreciated that the back portion 81 is fixed relative to the stanchion 12.

In another embodiment, the back portion 81 may include a lounge mechanism, generally indicated at 114, for allowing the back cushion 82 to lounge back and forth within a predetermined angle. The lounge mechanism 114 includes a bushing member 116 extending outwardly from the base wall 104 of the attachment bracket 102 near an upper end thereof. The lounge mechanism 114 also includes a pin member 118 extending outwardly from the base wall 96 of the side housing 94 and having a slot 119 therein. The lounge mechanism 114 includes a spring 120 of a leaf type having a lower end wrapped about the pin member 118 and disposed in the slot 119 and an upper end disposed against the bushing member 116. The spring 120 urges the back portion 81 to a forward upright position. The lounge mechanism 114 also includes a slot 122 in the base wall 96 of the side housing 94. The slot 122 is preferably coated with a Teflon coating 124. The lounge mechanism 114 further includes a pin 126 disposed within the bushing member 116 and extending through the slot 122. The pin 126 is removably disposed in the bushing member 116. The slot 122 extends longitudinally and arcuately to allow the back portion 81 to lounge or move rearward back and forth within a predetermined angle of approximately sixteen degrees to twenty-four degrees.

The back portion 81 includes a back cover 128 to cover the back thereof. The back cover 128 has a generally rectangular shape, but may have any suitable shape. The back cover 128 is made of fiberglass reinforced co-polymer plastic material and formed by conventional injection molding processes. The back cover 78 has at least one, preferably a plurality of pairs of hooks 130 and a pair of apertures 132 that allow the back cover 128 to be attached to the back frame 88. The back cover 128 is disposed over the back of the back frame 88 and the hooks 130 are disposed over the selected ones of the bars 89. The back cover 128 is secured to the back frame 88 by suitable means such as fasteners 134 extending through the apertures 132 and engaging the lower flange 90 of the back frame 88. It should be appreciated that fiberglass strengthens the back cover 128.

The theater seat assembly 10 includes an armrest 136 connected to each of the stanchions 12. The armrest 136 extends longitudinally and has a generally rectangular shape. The armrest 136 has a flange portion 138 extending rearward for connection to the bracket 20 of the leg portion 14 of the stanchion 12. The flange portion 138 has a thickness less than the remainder of the armrest 136 and a generally circular shape. The flange portion 138 has a first or central aperture 140 extending axially therethrough. The flange portion 138 also has a second aperture 142 spaced above the first aperture 140 and extending axially therethrough. The flange portion 138 also has a curved or arcuate slot 144 spaced below the first aperture 140. The flange portion 138 is disposed between the flanges of the bracket 20 and pivotally connected thereto by suitable means such as a first fastener 146 extending through the first aperture 140 and apertures 2o*a*. In one embodiment, the armrest 136 includes a second fastener 148 extending through the slot 144 of the flange portion 138 and apertures 20*a* of the bracket 20 to allow the armrest 136 to pivot relative thereto. In another embodiment, the second fastener 148 extends through the second aperture 142 of the flange portion 138 and apertures 20*a* to fix the armrest 136 relative to the bracket 20. It should be appreciated that the fasteners 146 and 148 may be threadably engaged and secured by nuts (not shown).

The armrest 136 also has a cup holder portion 150 at a forward end thereof. The cup holder portion 150 is generally circular in shape and has a generally circular cavity 152 therein to receive a cup (not shown). The cup holder portion 150 has a bottom wall 154 forming a bottom of the cavity 152 and a plurality of apertures 156 extending through the bottom wall 154 to allow objects to pass therethrough. The cup holder portion 150 may have a step or shoulder 156 forming an enlarged portion of the cavity 152 to allow different sized cups to rest thereon. The armrest 136 is made of a plastic material and may have a padding material 157 on a top portion thereof.

The theater seat assembly 10 may include a side panel 158 attached to the theater seat on an aisle side thereof. The side panel 158 is generally rectangular in shape and made of a plastic material. The side panel 158 is connected to the aisle side stanchion 12 by suitable means such as fasteners 160.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A theater seat assembly comprising:

a pair of opposed stanchions;

a generally horizontal seat portion disposed between and operatively connected to said stanchions;

a generally upright back portion disposed between and operatively connected to said stanchions, said back portion including a back frame and a pair of opposed side housings at a lower end thereof, each of said side housings including a first pin extending outwardly; and a lounge mechanism operatively connected to said back portion and said stanchions to allow said back portion to lounge rearward relative to said stanchions, wherein said lounge mechanism comprises a second pin operatively connected to each of said stanchions and a slot on each side of said back portion to receive said second pin and limit movement of said back portion within a predetermined range; and a leaf spring cooperating with said first pin and said second pin to urge said back frame to a forward upright position.

2. A theater seat assembly as set forth in claim 1 wherein each of said side housings has a recess disposed about said second pin to allow said back frame to pivot relative to said stanchions.

3. A theater seat assembly as set forth in claim 1 wherein each of said stanchions includes a bushing member extending outwardly.

4. A theater seat assembly as set forth in claim 3 wherein each of said side housings includes said slot.

5. A theater seat assembly as set forth in claim 4 wherein said second pin is disposed in said bushing member and extends through said slot to limit movement of said side housings.

6. A theater seat assembly as set forth in claim 4 wherein said slot is coated with a Teflon coating.

7. A theater seat assembly comprising:

a pair of opposed stanchions and having a first pin;

a generally horizontal seat portion disposed between and operatively connected to said stanchions;

a generally upright back portion disposed between and operatively connected to said stanchions; and a lounge mechanism operatively connected to said back portion and said stanchions to allow said back portion to lounge rearward relative to said stanchions, wherein said lounge mechanism comprises a second pin operatively connected to each of said stanchions, a slot on each side of said back portion to receive said second pin and limit movement of said back portion within a predetermined range, and a leaf spring cooperating with said first pin and said second pin to urge said back portion to a forward upright position.

* * * * *